US011355840B2

(12) United States Patent
Achour

(10) Patent No.: US 11,355,840 B2
(45) Date of Patent: Jun. 7, 2022

(54) METHOD AND APPARATUS FOR A METASTRUCTURE SWITCHED ANTENNA IN A WIRELESS DEVICE

(71) Applicant: Metawave Corporation, Palo Alto, CA (US)

(72) Inventor: Maha Achour, Palo Alto, CA (US)

( * ) Notice: Subject to any disclaimer, the term of this patent is extended or adjusted under 35 U.S.C. 154(b) by 153 days.

(21) Appl. No.: 16/249,882

(22) Filed: Jan. 16, 2019

(65) Prior Publication Data

US 2019/0221929 A1 Jul. 18, 2019

Related U.S. Application Data

(60) Provisional application No. 62/618,045, filed on Jan. 16, 2018.

(51) Int. Cl.

| | |
|---|---|
| ***H01Q 3/24*** | (2006.01) |
| ***H01Q 21/00*** | (2006.01) |
| ***H01Q 25/00*** | (2006.01) |
| ***H01Q 5/371*** | (2015.01) |
| ***H01Q 1/24*** | (2006.01) |
| ***H01Q 15/00*** | (2006.01) |

(52) U.S. Cl.

CPC ..... *H01Q 3/24* (2013.01); *H01Q 1/243* (2013.01); *H01Q 5/371* (2015.01); *H01Q 15/0086* (2013.01); *H01Q 21/0025* (2013.01); *H01Q 21/0075* (2013.01); *H01Q 21/0093* (2013.01); *H01Q 25/00* (2013.01); *H01Q 25/002* (2013.01)

(58) Field of Classification Search

CPC H01Q 1/243; H01Q 3/24; H01Q 3/26; H01Q 3/30; H01Q 3/34; H01Q 3/36; H01Q 21/0025; H01Q 21/0075; H01Q 21/0093; H01Q 21/06; H01Q 21/061; H01Q 21/29; H01Q 25/002; H01Q 5/37; H01Q 5/371; H01Q 1/24; H01Q 15/00; H01Q 15/0086; H01Q 25/00; H01Q 3/00; H01Q 3/28; H01Q 21/00; H01Q 21/20

See application file for complete search history.

(56) References Cited

U.S. PATENT DOCUMENTS

| | | | | |
|---|---|---|---|---|
| 9,667,290 | B2 * | 5/2017 | Ouyang | H01Q 21/065 |
| 9,972,877 | B2 * | 5/2018 | Casse | H01Q 3/36 |
| 10,312,600 | B2 * | 6/2019 | Hower | H01Q 1/288 |
| 11,005,179 | B2 * | 5/2021 | Achour | H01Q 21/061 |
| 2019/0036224 | A1 * | 1/2019 | McCollough | H04B 7/02 |
| 2019/0326670 | A1 * | 10/2019 | Pelletti | H01Q 3/2641 |
| 2021/0257732 | A1 * | 8/2021 | Achour | H01Q 21/064 |

* cited by examiner

*Primary Examiner* — Tho G Phan

(74) *Attorney, Agent, or Firm* — Sandra Lynn Godsey

(57) ABSTRACT

Examples disclosed herein relate to a wireless device having a plurality of metastructure switched antennas, each metastructure switched antenna having an array of metastructures. A controller in the wireless device selects a metastructure switched antenna from the plurality of metastructure switched antennas and determines a direction for transmission of a beam from the selected metastructure switched antenna.

20 Claims, 7 Drawing Sheets

METHOD AND APPARATUS FOR A METASTRUCTURE SWITCHED ANTENNA IN A WIRELESS DEVICE

CROSS-REFERENCE TO RELATED APPLICATIONS

This application claims priority to U.S. Provisional Application No. 62/618,045, filed on Jan. 16, 2018, and incorporated herein by reference.

BACKGROUND

Many transmission systems, such as wireless systems, operate in an ever-expanding sphere of connectivity. Mobile data traffic demands continue to grow every year, challenging wireless systems to provide greater speed, connect more devices, have lower latency, and transmit more and more data at once. Users now expect instant wireless connectivity regardless of the environment and circumstances, whether it is in an office building, a public space, an open preserve, or a vehicle. Wireless connectivity is available in a wide range of devices with efficiency requirements. In these devices and applications, there is a desire to reduce the power consumption, spatial footprint and computing power for operation of the wireless antenna and transmission structure.

BRIEF DESCRIPTION OF THE DRAWINGS

The present application may be more fully appreciated in connection with the following detailed description taken in conjunction with the accompanying drawings, which are not drawn to scale and in which like reference characters refer to like parts throughout, and wherein.

DETAILED DESCRIPTION

Methods and apparatuses for a Metastructure Switched Antenna ("MSA") in a wireless device are disclosed. A MSA is positioned within a wireless device so as to improve the coverage available for the wireless device. A metastructure, as generally described herein, is an engineered structure with electromagnetic properties not found in nature. In various examples, a MSA has an array of non- or semi-periodic structures that are spatially distributed to provide a specific phase and frequency distribution and capable of controlling and manipulating EM radiation at a desired direction. The MSA array is fed and controlled so as to switch its transmission beams to one of multiple positions.

In various examples, a wireless device may include multiple MSAs positioned at the perimeter of the device, wherein the device determines which antenna to use in a given situation. This considers where the device is located, where the user is holding the device, the communication type used in the device, the environmental noise, and so forth. The device selects an MSA for transmission and then determines the best transmission angle/phase shift for its transmission beam. In various examples, this may involve cycling through multiple phase shifts to determine the best beam.

It is appreciated that, in the following description, numerous specific details are set forth to provide a thorough understanding of the examples. However, it is appreciated that the examples may be practiced without limitation to these specific details. In other instances, well-known methods and structures may not be described in detail to avoid unnecessarily obscuring the description of the examples. Also, the examples may be used in combination with each other.

Figure 1:
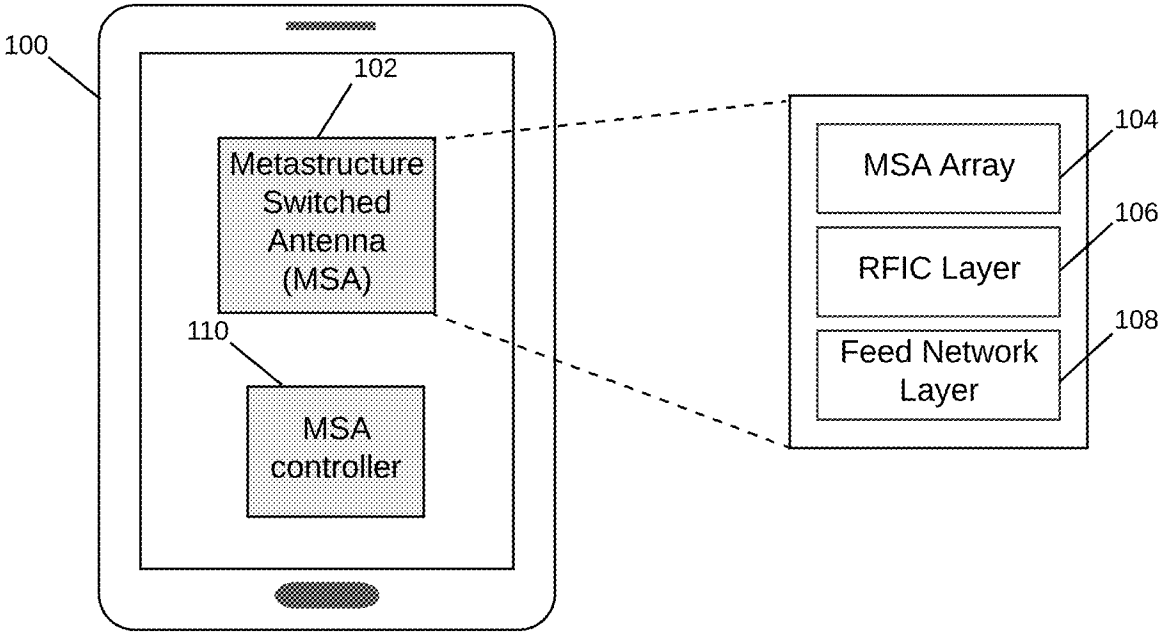
FIG. 1 is a schematic diagram of a wireless device with a Metastructure Switched Antenna ("MSA") in accordance with various examples.

FIG. 1 is a schematic diagram of a wireless device with a MSA in accordance with various examples. Wireless device 100 has MSA 102 to transmit RF beams which are switchable to multiple directions and positions as desired. The MSA 102 includes multiple layers of dielectric substrates in which various structures are formed. In various examples and as described in more detail below, MSA 102 includes an MSA array 104 of metastructure cells, an RFIC layer 106 implemented as a Monolithic Microwave Integrated Circuit ("MMIC"), and a feed network layer 108 that is a type of a power divider circuit such that it takes an input signal and divides it through a network of paths or transmission lines to reach the MSA array cells. The feed network layer 108 is designed to be impedance-matched, such that the impedances at each end of a transmission line matches the characteristic impedance of the line. The RFIC layer 106 includes phase shifters (e.g., a varactor, a set of varactors, a phase shift network, or a vector modulator architecture) to achieve any desired phase shift from 0° to 360°. In some examples, a transmission array structure (not shown) is coupled to the MSA array 104 such that the input signal from the feed network layer 108 and through the RFIC layer 106 is radiated through slots or discontinuities in the transmission array to the cells in the MSA array 104.

Wireless device 100 also includes MSA controller 110 to determine phase shifts for transmission beams generated from MSA 102. MSA controller 110 may also serve to select an MSA to use in a given situation when the wireless device has multiple MSAs. This considers where the device is located, where the user is holding the device, the communication type used in the device, the environmental noise, and so forth.

Figure 2B:
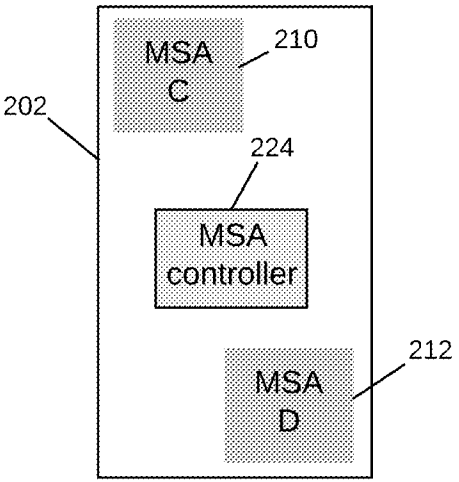
FIGS. 2A-C illustrate MSA placement in a wireless device having multiple MSAs in accordance with various examples.
Figure 2A:
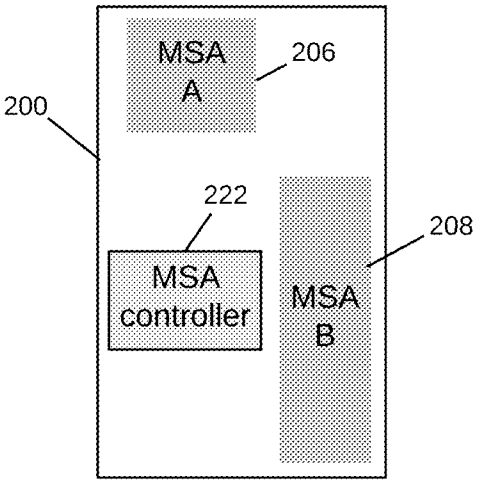
Figure 2C:
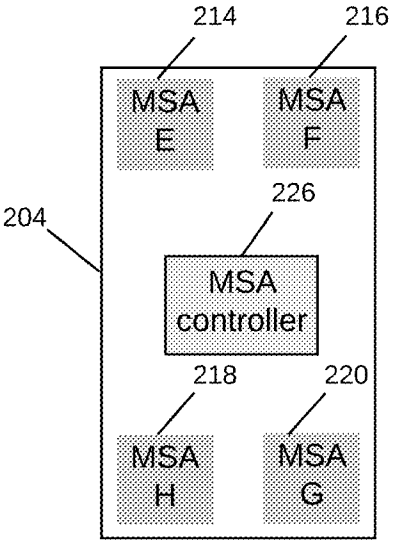

FIGS. 2A-C illustrates MSA placement in a wireless device having multiple MSAs. Wireless devices 200-204 have a plurality of MSAs positioned in different locations. Each wireless device has an MSA controller, e.g., MSA controllers 222-226, to determine which MSA to use at any given time and at which direction to transmit RF beams from the selected MSA. The MSAs may be the same or different sizes, such as in device 200 of FIG. 2A with different sized MSA A 206 and MSA B 208. The position of each antenna MSA A 206 and MSA B 208 may be determined by the anticipated use of the device 200 as well as the proximity to the other antenna. FIG. 2B provides another design having antennas MSA C 210 and MSA D 212 positioned at opposite corners of device 202. FIG. 2C illustrates a device 204 having four MSAs, positioned at the corners of the device 204. Note that each of the antennas, such as MSA E 214, MSA F 216, MSA G 218, and MSA H 220, may include multiple MSA arrays. There are a variety of combinations possible.

In operation, one or more MSAs may transmit multiple RF beams, which are switchable to multiple positions as illustrated with wireless device 300 having MSA E 302, MSA F 304, MSA G 306 and MSA H 308 positioned at its corners. MSA controller 310 selects which MSA or MSAs out of MSAs 302-308 will be used for transmission at any given time. Once the selection is made, MSA controller 310 selects the desired directions for the transmission beams. Switching between directions is implemented by the phase shifters in the RFIC layer 106 shown in FIG. 6. The phase shifters generate the phase shifts needed for beams to be directed to the desired positions. In some examples, the phase shifts may be generated directly in the individual MSA array cells, such as through reactance control of the cells.

Figure 4:
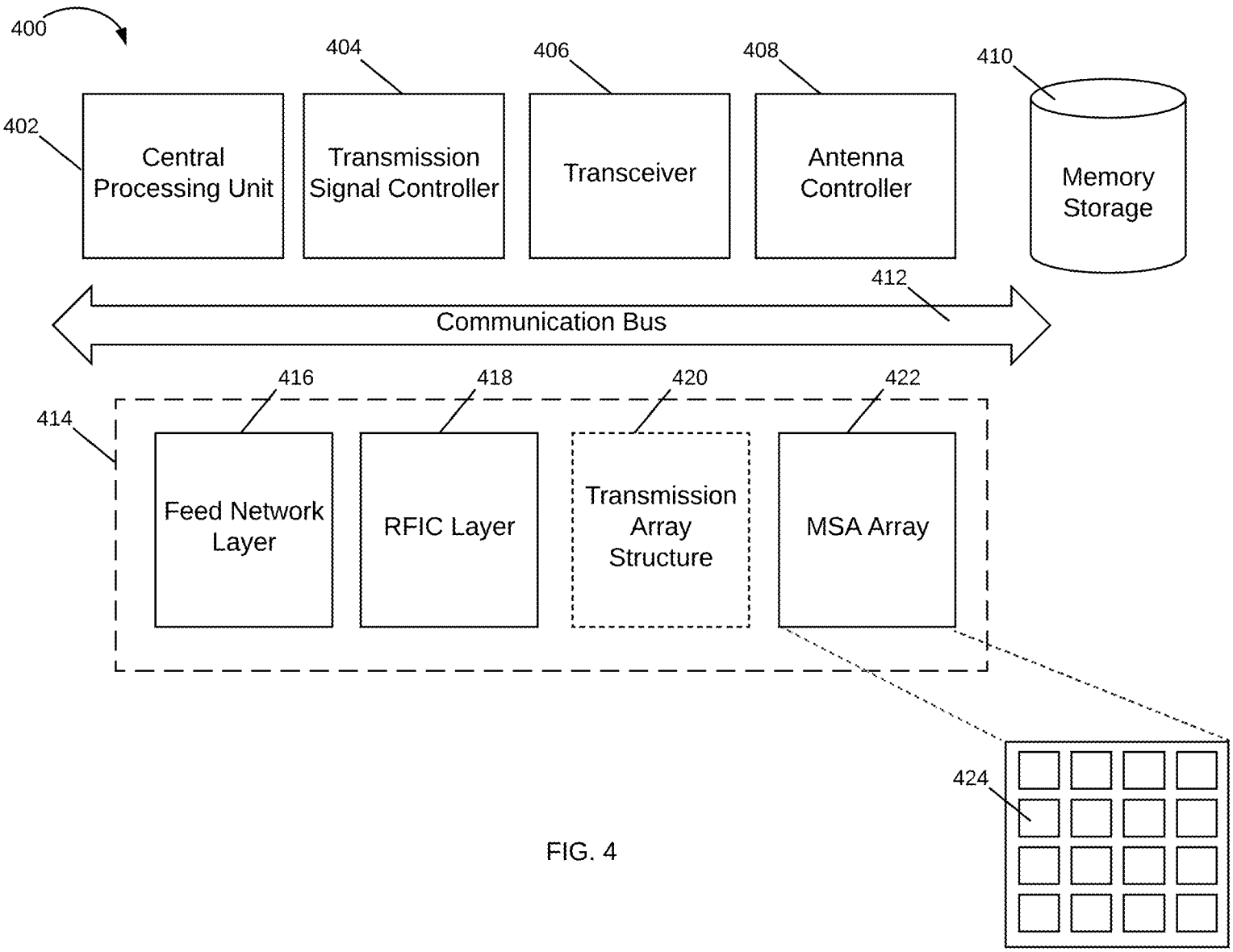
FIG. 4 is a schematic diagram of a MSA system in more detail and in accordance with various examples.

Attention is now directed to FIG. 4, which shows a schematic diagram of a MSA system in more detail and in accordance with various examples. MSA system 400 in a wireless device has a MSA 414 coupled to an antenna controller 408, a central processing unit 402, a transmission signal controller 404, and a transceiver 406. The transmission signal controller 404 generates a cellular modulated signal, such as an Orthogonal Frequency Division Multiplexed ("OFDM") signal. In some examples, the signal is provided to the MSA 414 and the transmission signal controller 404 may act as an interface, translator or modulation controller, or otherwise as required for the signal to propagate through the MSA 414. The received signal information may be stored in a memory storage unit 410, wherein the information structure may be determined by the type or transmission and modulation pattern.

The MSA 414 radiates the signal through a structure consisting of three main layers: (1) feed network layer 416; (3) RFIC layer 418; and (4) MSA array 422. In some examples, a transmission array structure 420 implemented with transmission lines with a plurality of slots and discontinuities for radiating the input signal to the MSA array 422 may be implemented. In other examples, the MSA array 422 itself may be considered to be a transmission array structure, where the input signal is transmitted from the feed network layer 416 to the RFIC layer 418 before it reaches the cells in MSA array 422. A connector (not shown) may be used to couple the transmission signal from the transmission signal controller 404 for transmission to the feed network layer 416.

Figure 3:
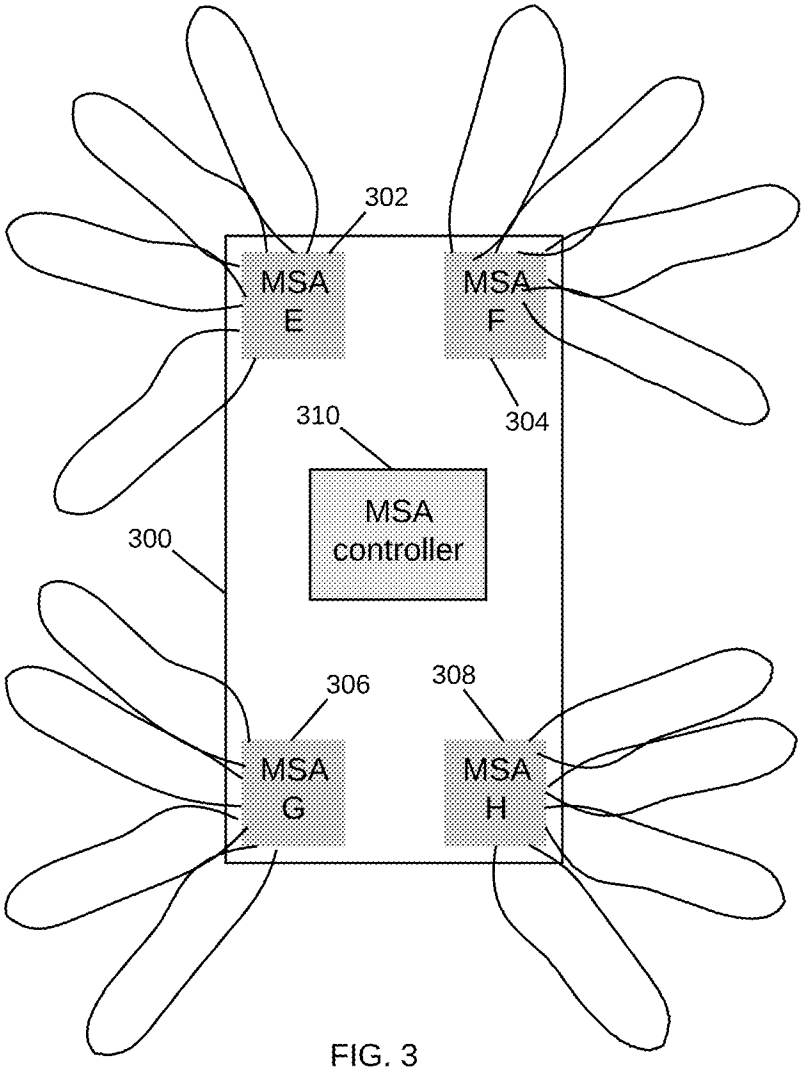
FIG. 3 illustrates a wireless device having multiple MSAs generating switchable RF beams in accordance with various examples.

In various examples, the feed network layer 416 is a corporate feed structure having a plurality of transmission lines for transmitting the signal to the RFIC layer 418 and MSA array 422. The RFIC layer 418 is implemented as a MMIC and includes phase shifters (e.g., a varactor, a set of varactors, a phase shift network, or a vector modulator architecture) to achieve any desired phase shift from 0° to 360°. The RFIC layer 418 may also include transitions from the feed network layer 416 to the RFIC layer 418 and from the RFIC layer 418 to the MSA array 422 (or to the transmission array structure 420, when present). Note that as illustrated, there is one MSA 414 in system 400. However, as shown in FIGS. 2A-C and in FIG. 3, there may be multiple MSAs in a wireless device in any given configuration.

In operation, the antenna controller 408 receives information from other modules in system 400 (e.g., an MSA controller) indicating a next RF beam, wherein an RF beam may be specified by parameters such as beam width, transmit angle, transmit direction and so forth. The antenna controller 408 directs the RFIC layer 418 to generate RF beams with the desired beam parameters. Transceiver 406 prepares a signal for transmission, wherein the signal is defined by modulation and frequency. The signal is received by the MSA 414 and the desired phase shifts are adjusted at the direction of the antenna controller 408 in communication with the MSA controller in the wireless device. The signal propagates through the feed network layer 416 to the MSA array 422 of metastructure cells (e.g., cell 424) for transmission through the air. Each cell or subarray of cells may be coupled to a set of phase shifters in the RFIC layer 418 for controlling their phase.

In some examples, the cells in MSA array 422 are metamaterial ("MTM") cells. An MTM cell is an artificially structured element used to control and manipulate physical phenomena, such as the electromagnetic properties of a signal including its amplitude, phase, and wavelength. Metamaterial cells behave as derived from inherent properties of their constituent materials, as well as from the geometrical arrangement of these materials with size and spacing that are much smaller relative to the scale of spatial variation of typical applications.

A metamaterial is a geometric design of a material, such as a conductor, wherein the shape creates a unique behavior for the device. An MTM cell may be composed of multiple microstrips, gaps, patches, vias, and so forth having a behavior that is the equivalent to a reactance element, such as a combination of series capacitors and shunt inductors. Various configurations, shapes, designs and dimensions are used to implement specific designs and meet specific constraints. In some examples, the number of dimensional degrees of freedom determines the characteristics of a cell, wherein a cell having a number of edges and discontinuities may model a specific-type of electrical circuit and behave in a given manner. In this way, an MTM cell radiates according to its configuration. Changes to the reactance parameters of the MTM cell result in changes to its radiation pattern. Where the radiation pattern is changed to achieve a phase change or phase shift, the resultant structure is a powerful antenna, as small changes to the MTM cell can result in large changes to the beamform. The MSA array of cells 422 can be configured so as to form a beamform or multiple beamforms involving subarrays of the cells or the entire array.

The MTM cells 422 may include a variety of conductive structures and patterns, such that a received transmission signal is radiated therefrom. In some examples, each MTM cell may have unique properties. These properties may include a negative permittivity and permeability resulting in a negative refractive index; these structures are commonly referred to as left-handed materials ("LHM"). The use of LHM enables behavior not achieved in classical structures and materials, including interesting effects that may be observed in the propagation of electromagnetic waves, or transmission signals. Metamaterials can be used for several interesting devices in microwave and terahertz engineering such as antennas, sensors, matching networks, and reflectors, such as in telecommunications, automotive and vehicular, robotic, biomedical, satellite and other applications. For antennas, metamaterials may be built at scales much smaller than the wavelengths of transmission signals radiated by the metamaterial. Metamaterial properties come from the engineered and designed structures rather than from the base material forming the structures. Precise shape, dimensions, geometry, size, orientation, arrangement and so forth result in the smart properties capable of manipulating electromagnetic waves by blocking, absorbing, enhancing, or bending waves.

Figure 5:
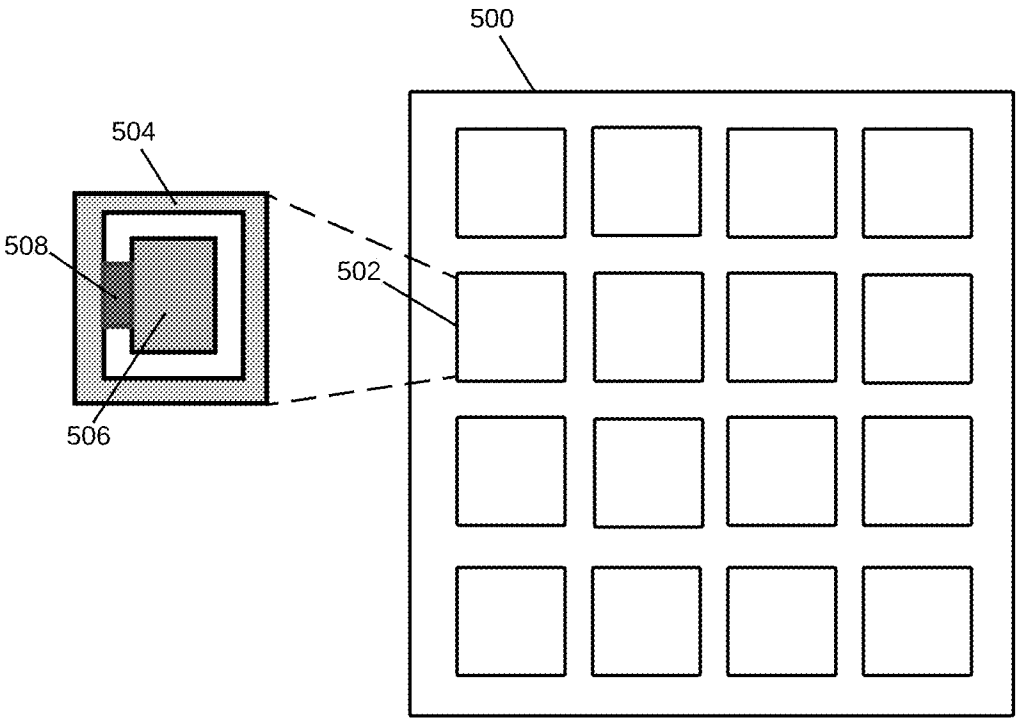
FIG. 5 is a schematic diagram of a metamaterial cell in a MSA array in accordance with various examples.

In some examples, in lieu of the RFIC layer 418, each MTM cell may include a reactance control mechanism (e.g., a varactor) to change the capacitance and/or other parameters of the MTM cell. By changing a parameter of the MTM cell, the resonant frequency is changed, and therefore, the array 422 may be configured and controlled to direct beams to multiple positions. An example of such a cell is illustrated in FIG. 5 as MTM cell 502 in MSA array 500. MTM cell 502 has a conductive outer portion or loop 504 surrounding a conductive area 506 with a space in between. Each MTM cell 502 may be configured on a dielectric layer, with the conductive areas and loops provided around and between different MTM cells. A voltage controlled variable reactance device 508, e.g., a varactor, provides a controlled reactance between the conductive area 506 and the conductive loop 504 based on a bias voltage. By altering the reactance of MTM cells 502, signals radiated from MSA array 500 are formed into beams having a beam width and direction as determined by such control. The individual unit cells 502 may be arranged into sub arrays that enable multiple beamforms in multiple directions concurrently. Note that with cells 502 having a varactor 508, there is no need for the RFIC layer to provide phase shifts. The phase shifts in this case are provided by the varactors within the cells. The RFIC layer in this example may be used for other purposes, such as for amplification.

Figure 6:
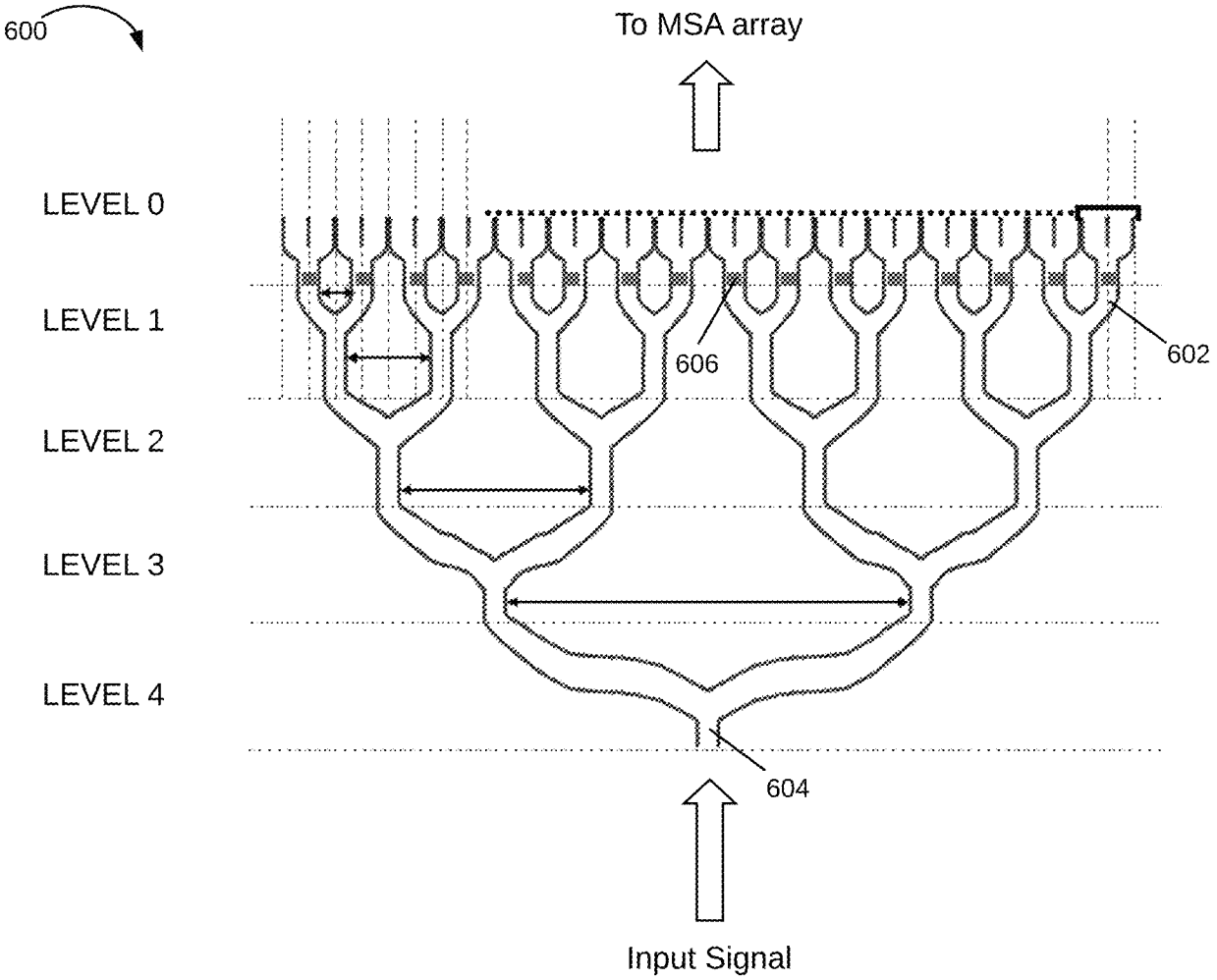
FIG. 6 is a schematic diagram of a feed network layer for use in a MSA system implemented as in FIG. 4 and in accordance with various examples.

Attention is now directed to FIG. 6, which shows a schematic diagram of a feed network layer for use in a MSA system implemented as in FIG. 4 and in accordance with various examples. Feed network 600 is a type of a power divider circuit such that it takes an input signal and divides it through a network of coupling paths or transmission lines 602 that are formed from vias in a substrate. These vias extend through a second conductive layer in the substrate and are lined, or plated, with conductive material. The transmission lines 602 act to distribute the received transmission signal to the MSA array 422 (or transmission array structure 420, when present) of FIG. 4. Each transmission line receives a proportional share of the transmission signal and may have similar dimensions; however, the size of the transmission lines may be configured to achieve a desired transmission and/or radiation result. In various examples, the feed network 600 is designed to be impedance-matched, such that the impedances at each end of a transmission line matches the characteristic impedance of the line. Matching vias such as matching via 604 may be incorporated in the coupling paths to improve impedance matching.

In the illustrated example, there are 32 coupling paths, corresponding to 32 rows of MSA array cells. Alternate examples may use traditional or other waveguide structures or transmission signal guide structures. Coupling matrix 600 has 5 levels, wherein in each level the transmission paths are doubled: level 4 has 2 paths, level 3 has 4 paths, level 2 has 8 paths, level 1 has 16 paths, and level 0 has 32 paths. In various examples, the RFIC layer 418 of FIG. 4 may be embedded in each transmission line, e.g., RFIC 606, to change the reactance and thus the phase of a transmission line such as transmission line 604.

Figure 7:
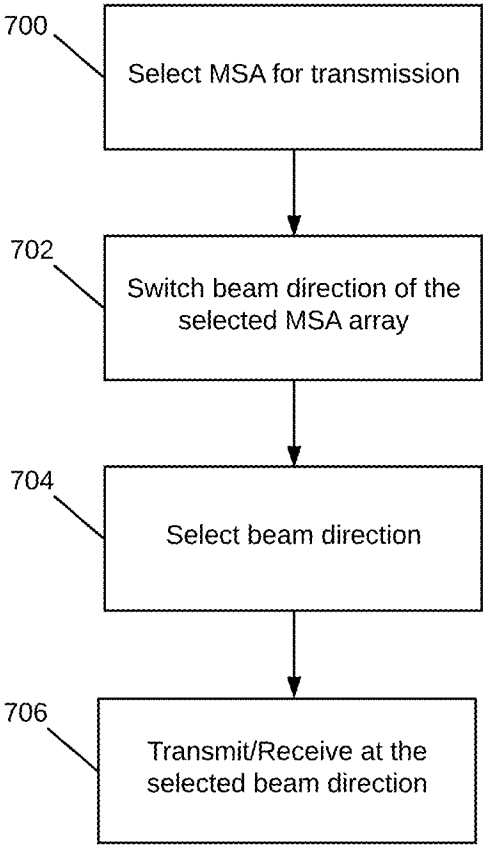
FIG. 7 is a flowchart for operation of a wireless device having a MSA in accordance with various examples.

Referring now to FIG. 7, a flowchart for operation of a wireless device having a MSA in accordance with various examples is described. First, a MSA is selected for transmission by a MSA controller from the plurality of MSAs in the wireless device (700). Next, the MSA controller in the wireless device switches the beam direction of the selected MSA array (702) to find the optimum transmission with the selected direction (704). After selection of the beam direction, the wireless device transmits and receives at this position (706). During operation, the MSA controller in the wireless device continues to determine the best MSA and beam direction for operation. The beam direction, as described above, is controlled by adjustment of phase shifts provided by an RFIC layer or varactors in MTM cells in the MSA array.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. A wireless device, comprising:

a plurality of metastructure switched antennas, each metastructure switched antenna comprising a first layer comprising a feed network layer, a second layer comprising an RFIC layer, and a third layer comprising an array of metastructures; and a controller for selecting a metastructure switched antenna from the plurality of metastructure switched antennas and determining a direction for transmission of a beam from the selected metastructure switched antenna.

2. The wireless device of claim 1, wherein the feed network layer comprises a plurality of transmission paths to distribute a transmission signal to the array of metastructures, each transmission path receiving a proportional share of the transmission signal.

3. The wireless device of claim 1, wherein the RFIC layer is adapted to switch the beam to a plurality of directions.

4. The wireless device of claim 1, wherein the array of metastructures comprises an array of metamaterial cells.

5. The wireless device of claim 4, wherein each metamaterial cell in the array of metamaterial cells comprises:

a conductive outer loop; and a conductive patch circumscribed within the conductive outer loop, wherein a reactance control device is placed between the conductive outer loop and the conducive patch.

6. The wireless device of claim 5, wherein the reactance control device comprises a varactor to generate a plurality of phase shifts.

7. The wireless device of claim 1, wherein the RFIC layer comprises a plurality of phase shifters selected from a varactor, a set of varactors, a phase shift network, and a vector modulator to generate a plurality of phase shifts.

8. The wireless device of claim 1, wherein the array of metastructure cells is arranged into a plurality of subarrays for transmitting multiple beams in multiple directions.

9. A metastructure switched antenna system for use in a wireless device, comprising:

a metastructure switched antenna comprising a first layer comprising a feed network layer, a second layer comprising an RFIC layer, and a third layer comprising an array of metastructures; and an antenna controller in communication with a metastructure switched antenna controller in the wireless device configured to control a direction of a beam transmitted from the metastructure switched antenna.

10. The metastructure switched antenna system of claim 9, further comprising a transmission signal controller to generate a transmission signal for the metastructure switched antenna.

11. The metastructure switched antenna system of claim 9, wherein the feed network layer comprises a plurality of transmission paths configured to distribute the transmission signal to the array of metastructures, each transmission path receiving a proportional share of the transmission signal.

12. The metastructure switched antenna system of claim 9, wherein the RFIC layer is adapted to switch the beam to a plurality of directions.

13. The metastructure switched antenna system of claim 12, wherein the RFIC layer comprises a plurality of phase shifters selected from a varactor, a set of varactors, a phase shift network, and a vector modulator configured to generate a plurality of phase shifts.

14. The metastructure switched antenna system of claim 9, wherein the array of metastructures comprises an array of metamaterial cells, each metamaterial cell comprising a conductive outer loop; and a conductive patch circumscribed within the conductive outer loop, wherein a reactance control device is placed between the conductive outer loop and the conducive patch.

15. The metastructure switched antenna system of claim 9, wherein the antenna controller receives information from the metastructure switched antenna controller indicating a next RF beam specified by parameters comprising a beam width, a transmit angle, and a transmit direction.

16. A method for operating a wireless device having a plurality of metastructure switched antennas, the method comprising:

selecting a metastructure switched antenna from the plurality of metastructure switched antennas, each metastructure switched antenna comprising a first layer comprising a feed network layer, a second layer comprising an RFIC layer, and a third layer comprising an array of metastructure cells;

switching a direction of a beam to be transmitted from the selected metastructure switched antenna;

selecting a beam direction; and transmitting the beam at the selected beam direction.

17. The method of claim 16, wherein switching the direction of the beam to be transmitted from the selected metastructure switched antenna comprises directing the RFIC layer in the selected metastructure switched antenna to generate a phase shift corresponding to the direction of the beam.

18. The method of claim 16, wherein switching a direction of the beam to be transmitted from the selected metastructure switched antenna comprises generating a bias voltage for a reactance control device in a metastructure cell in the array of metastructure cells.

19. The method of claim 16, wherein selecting the beam direction comprises informing the selected beam direction to an antenna controller in the metastructure switched antenna.

20. The method of claim 16, wherein transmitting the beam at the selected beam direction comprises radiating the beam at the selected beam direction from the array of metastructures in the selected metastructure switched antenna.

* * * * *